US011183136B2

(12) United States Patent
Kim et al.

(10) Patent No.: US 11,183,136 B2
(45) Date of Patent: Nov. 23, 2021

(54) DISPLAY DEVICE CAPABLE OF CHANGING FRAME RATE AND METHOD OF DRIVING THE SAME

(71) Applicant: Samsung Display Co., Ltd., Yongin-Si (KR)

(72) Inventors: Dongkeon Kim, Cheonan-si (KR); Seonghyeon Kim, Hwaseong-si (KR); Suji Han, Incheon (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 24 days.

(21) Appl. No.: 16/381,395

(22) Filed: Apr. 11, 2019

(65) Prior Publication Data

US 2020/0005723 A1 Jan. 2, 2020

(30) Foreign Application Priority Data

Jun. 28, 2018 (KR) ..... 10-2018-0074981

(51) Int. Cl.
*G09G 3/36* (2006.01)

(52) U.S. Cl.
CPC ..... *G09G 3/3688* (2013.01); *G09G 3/3614* (2013.01); *G09G 3/3696* (2013.01); *G09G 2310/027* (2013.01); *G09G 2310/0286* (2013.01); *G09G 2320/0247* (2013.01); *G09G 2320/0276* (2013.01); *G09G 2320/0673* (2013.01); *G09G 2340/0435* (2013.01); *G09G 2370/08* (2013.01)

(58) Field of Classification Search
CPC ..... G09G 2310/027; G09G 2310/0286; G09G 2320/0247; G09G 2320/0276; G09G 2320/0673; G09G 2340/0435; G09G 2370/08; G09G 3/3614; G09G 3/3688; G09G 3/3696
See application file for complete search history.

(56) References Cited

U.S. PATENT DOCUMENTS 9,318,069 B2 4/2016 Nambi et al.
9,728,136 B2 * 8/2017 Pyo ..... G09G 3/2022
(Continued)

FOREIGN PATENT DOCUMENTS

KR 101709087 B1 2/2017
KR 101774127 B1 9/2017

OTHER PUBLICATIONS

Samsung User Manual—S*H85*, pp. 4-57, Samsung Electronics.

*Primary Examiner* — Ram A Mistry
(74) *Attorney, Agent, or Firm* — Cantor Colburn LLP

(57) ABSTRACT

A display device includes a display panel including gate lines, data lines, and pixels connected to the gate lines and the data lines and a driving circuit which controls the display panel in response to an image signal, a control signal, and a mode signal from an outside to display an image through the display panel. The driving circuit converts the image signal to data voltage signals corresponding to a first gamma curve to apply the data voltage signals to the data lines when the mode signal represents a normal mode and converts the image signal to data voltage signals corresponding to a second gamma curve different from the first gamma curve to apply the data voltage signals to the data lines when the mode signal represents a frequency variable mode.

19 Claims, 10 Drawing Sheets

(56) References Cited

U.S. PATENT DOCUMENTS

| | | | | |
|---|---|---|---|---|
| 2007/0273787 | A1* | 11/2007 | Ogino | H04N 7/015 348/441 |
| 2008/0055134 | A1* | 3/2008 | Li | H03M 1/76 341/144 |
| 2014/0092150 | A1* | 4/2014 | Slavenburg | G09G 5/12 345/698 |
| 2015/0103104 | A1* | 4/2015 | Lee | G09G 3/3648 345/690 |
| 2016/0035320 | A1 | 2/2016 | Yoon et al. | |
| 2016/0104408 | A1* | 4/2016 | Kim | G09G 3/36 345/690 |

* cited by examiner

DISPLAY DEVICE CAPABLE OF CHANGING FRAME RATE AND METHOD OF DRIVING THE SAME

This U.S. application claims priority to Korean Patent Application No. 10-2018-0074981, filed on Jun. 28, 2018, and all the benefits accruing therefrom under 35 U.S.C. § 119, the content of which in its entirety is herein incorporated by reference.

BACKGROUND

1. Field

Exemplary embodiments of the invention relate to a display device capable of changing a frame rate and a method of driving the display device.

2. Description of the Related Art

A display device generally includes gate lines, data lines, and pixels connected to the gate lines and the data lines. The display device further includes a gate driver that applies gate signals to the gate lines and a data driver that applies data signals to the data lines.

SUMMARY

A high-definition game image and a virtual reality image take a long time to render by a graphic processor. In a case where a rendering time with respect to an image signal of one frame becomes longer than a frame rate of a display device, a quality of an image displayed through the display device is deteriorated.

Exemplary embodiments of the invention provide a display device capable of changing a frame rate.

Exemplary embodiments of the invention provide a display device capable of improving a quality of display image during a frequency variable mode where the frame rate is changed and a method of driving the display device.

Exemplary embodiments of the invention provide a display device including a display panel including a plurality of gate lines, a plurality of data lines, and a plurality of pixels each being connected to a corresponding gate line of the plurality of gate lines and a corresponding data line of the plurality of data lines and a driving circuit that controls the display panel in response to an image signal, a control signal, and a mode signal from an outside to display an image through the display panel. The driving circuit converts the image signal to data voltage signals corresponding to a first gamma curve to apply the data voltage signals to the plurality of data lines when the mode signal represents a normal mode and converts the image signal to data voltage signals corresponding to a second gamma curve different from the first gamma curve to apply the data voltage signals to the plurality of data lines when the mode signal represents a frequency variable mode.

In an exemplary embodiment, a voltage level of the data voltage signals converted in the frequency variable mode is higher than a voltage level of the data voltage signals converted in the normal mode when the image signal has a predetermined grayscale level.

In an exemplary embodiment, the first gamma curve is formed with respect to a first common voltage level optimized when the image signal has a black image pattern, and the second gamma curve is formed with respect to a second common voltage level optimized when the image signal has a white image pattern.

In an exemplary embodiment, the frequency variable mode is an adaptive sync mode in which a frame rate is changed at least every frame, and the normal mode is a fixed frequency mode in which the frame rate is constant every frame.

In an exemplary embodiment, the driving circuit includes a gate driver that drives the plurality of gate lines, a data driver that applies the data voltage signals to the plurality of data lines based on an image data signal, a reference gamma selection signal, and at least one driving voltage, a voltage generating circuit that generates the at least one driving voltage in response to a voltage control signal, and a driving controller that controls the gate driver in response to the image signal, the control signal, and the mode signal and applies the image data signal and the reference gamma selection signal to the data driver. The driving controller outputs the voltage control signal and the reference gamma selection signal corresponding to the first gamma curve when the mode signal represents the normal mode and outputs the voltage control signal and the reference gamma selection signal corresponding to the second gamma curve when the mode signal represents the frequency variable mode.

In an exemplary embodiment, the driving controller includes a receiving circuit that restores a data enable signal and a clock signal based on the control signal and converts the mode signal to a frequency mode signal and a control signal generating circuit that applies a first control signal and a second control signal to the data driver and the gate driver, respectively, in response to the data enable signal and the clock signal, outputs the voltage control signal and the reference gamma selection signal corresponding to the first gamma curve when the frequency mode signal has a first level, and outputs the voltage control signal and the reference gamma selection signal corresponding to the second gamma curve when the frequency mode signal has a second level.

In an exemplary embodiment, the data enable signal includes a display period and a blank period in one frame, and a duration of the blank period of the data enable signal becomes different at least every frame in the frequency variable mode.

In an exemplary embodiment, the data driver includes a shift register that outputs latch clock signals in synchronization with the clock signal, a latch circuit that receives the image data signal and outputs a data signal in synchronization with the latch clock signals, a digital-to-analog converter ("DAC") that receives the reference gamma selection signal and the at least one driving voltage and converts the data signal output from the latch circuit to an analog voltage signal, and an output buffer that outputs the analog voltage signal to the plurality of data lines as the data voltage signals.

In an exemplary embodiment, the voltage generating circuit generates a first driving voltage and a second driving voltage in response to the voltage control signal.

In an exemplary embodiment, the DAC includes a resistor string that generates a plurality of gamma voltages between the first driving voltage and the second driving voltage, a reference voltage selecting circuit that selects gamma voltages among the plurality of gamma voltages in response to the reference gamma selection signal and outputs the selected gamma voltages as a plurality of reference gamma voltages, a voltage generator that generates a plurality of voltages based on the plurality of reference gamma voltages, and a decoder that outputs a voltage corresponding to the data signal among the plurality of voltages as the analog voltage signal.

In an exemplary embodiment, the reference voltage selecting circuit includes a plurality of selectors each of which receives the plurality of gamma voltages and outputs one of the plurality of gamma voltages as a reference gamma voltage of the plurality of reference gamma voltages in response to the reference gamma selection signal.

In an exemplary embodiment, the resistor string includes a plurality of resistors connected to each other in series between the first driving voltage and the second driving voltage and outputs voltages of connection nodes between the resistors as the plurality of gamma voltages.

Exemplary embodiments of the invention provide a display device including a display panel including a plurality of gate lines, a plurality of data lines, and a plurality of pixels each being connected to a corresponding gate line of the plurality of gate lines and a corresponding data line of the plurality of data lines, a gate driver driving the plurality of gate lines, a data driver that applies data voltage signals to the plurality of data lines based on an image data signal, a reference gamma selection signal, and at least one driving voltage, a voltage generating circuit that generates the at least one driving voltage in response to a voltage control signal, and a driving controller that controls the gate driver in response to an image signal, a control signal, and a mode signal from an outside and applies the image data signal and the reference gamma selection signal to the data driver. The driving controller outputs the voltage control signal and the reference gamma selection signal corresponding to a first common voltage level when the mode signal represents a normal mode and outputs the voltage control signal and the reference gamma selection signal corresponding to a second common voltage level different from the first common voltage level when the mode signal represents a frequency variable mode.

In an exemplary embodiment, the second common voltage level has a voltage level higher than a voltage level of the first common voltage level.

In an exemplary embodiment, the first common voltage level is a common voltage level optimized when the image signal has a black image pattern, and the second common voltage level is a common voltage level optimized when the image signal has a white image pattern.

In an exemplary embodiment, the voltage generating circuit generates a first driving voltage and a second driving voltage in response to the voltage control signal, and the data driver includes a resistor string that generates a plurality of gamma voltages between the first driving voltage and the second driving voltage, a reference voltage selecting circuit that selects gamma voltages among the plurality of gamma voltages in response to the reference gamma selection signal and outputs the selected gamma voltages as a plurality of reference gamma voltages, a voltage generator that generates a plurality of voltages based on the reference gamma voltages, and a decoder that outputs a voltage corresponding to a data signal among the voltages as an analog voltage signal.

In an exemplary embodiment, the frequency variable mode is an adaptive sync mode in which a frame rate is changed at least every frame, and the normal mode is a fixed frequency mode in which the frame rate is constant every frame.

Exemplary embodiments of the invention provide a method of driving a display device including receiving an image signal and a mode signal, converting the image signal to a data voltage signal corresponding to a first gamma curve when the mode signal represents a normal mode, converting the image signal to a data voltage signal corresponding to a second gamma curve different from the first gamma curve when the mode signal represents a frequency variable mode, and applying the data voltage signal to a plurality of data lines.

In an exemplary embodiment, the converting the image signal to the data voltage signal corresponding to the first gamma curve includes outputting a voltage control signal and a reference gamma selection signal corresponding to the first gamma curve, generating at least one driving voltage corresponding to the voltage control signal, selecting gamma signals among a plurality of gamma signals as reference gamma voltages in response to the reference gamma selection signal, and converting the image signal to the data voltage signal in response to the at least one driving voltage and the reference gamma voltages.

In an exemplary embodiment, the converting the image signal to the data voltage signal corresponding to the second gamma curve includes outputting a voltage control signal and a reference gamma selection signal corresponding to the second gamma curve, selecting gamma signals among the plurality of gamma signals as reference gamma voltages in response to the reference gamma selection signal, and converting the image signal to the data voltage signal in response to the at least one driving voltage and the reference gamma voltages.

According to the above, the display device converts the image signal to the data voltage signals corresponding to the first gamma curve during the normal mode to improve an afterimage phenomenon in which an image of a previous frame exerts influence on a current frame. In addition, the display device converts the image signal to the data voltage signals corresponding to the second gamma curve different from the first gamma curve during the frequency variable mode to reduce a brightness difference caused by changing the frame rate, thereby preventing a flicker phenomenon from occurring.

BRIEF DESCRIPTION OF THE DRAWINGS

The above and other advantages of the invention will become readily apparent by reference to the following detailed description when considered in conjunction with the accompanying drawings, in which.

DETAILED DESCRIPTION

Figure 1:
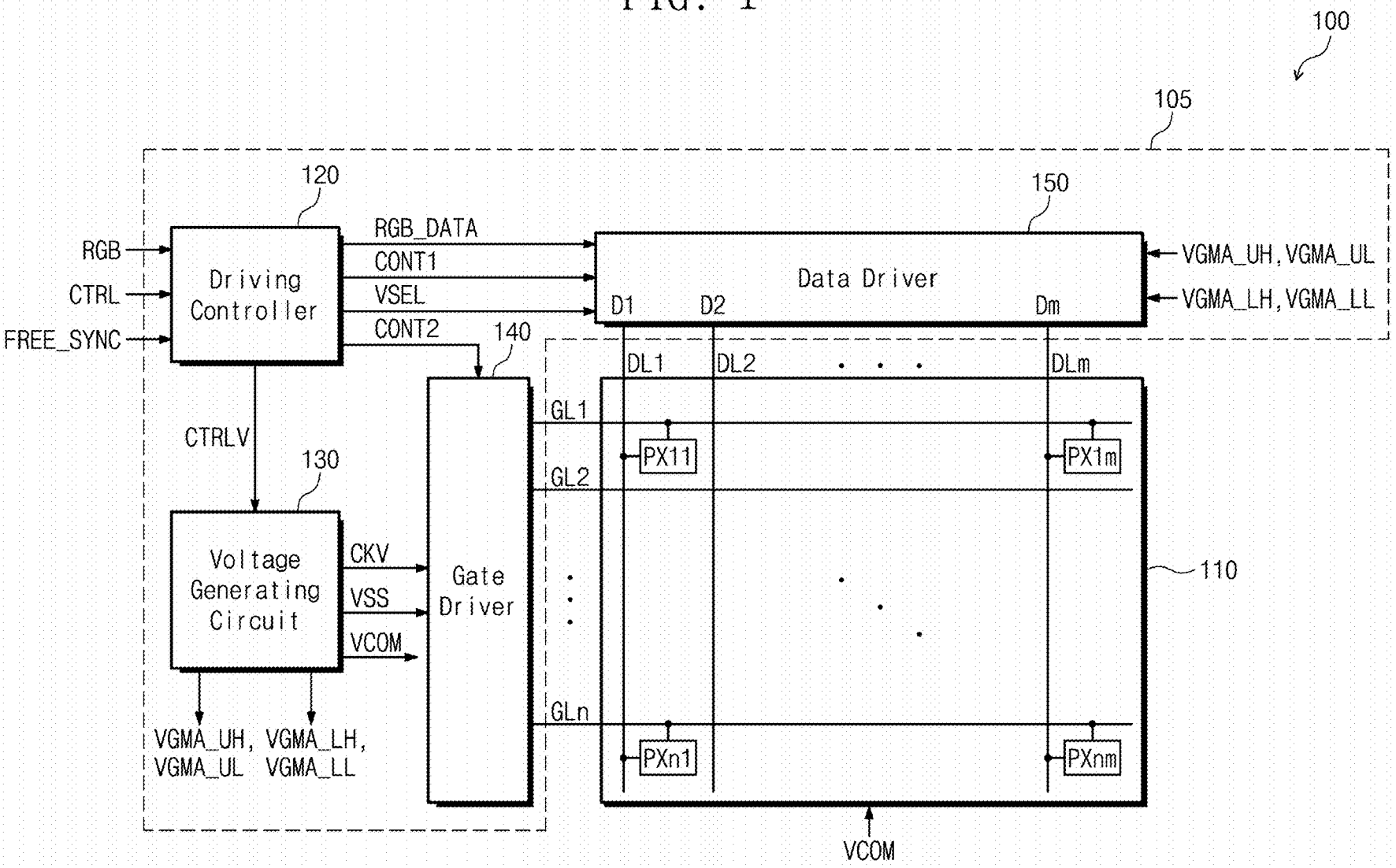
FIG. 1 is a block diagram showing an exemplary embodiment of a configuration of a display device according to the invention.

Hereinafter, exemplary embodiments of the disclosure will be described in detail with reference to the accompanying drawings. However, the disclosure may be variously modified and realized in many different forms, and thus the disclosure should not be construed as limited to the illustrated embodiments. Rather, these embodiments are provided as examples so that this disclosure will be thorough and complete and will fully convey the exemplary embodiments and features of the present disclosure to those skilled in the art.

It will be understood that when an element or layer is referred to as being "on", "connected to" or "coupled to" another element or layer, it can be directly on, connected or coupled to the other element or layer or intervening elements or layers may be present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
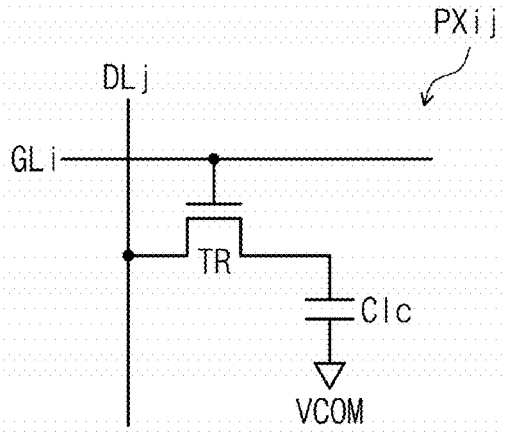
FIG. 2 is an equivalent circuit diagram of a pixel shown in FIG. 1.

FIG. 1 is a block diagram showing a configuration of a display device 100 according to an exemplary embodiment of the invention. FIG. 2 is an equivalent circuit diagram of a pixel shown in FIG. 1.

Referring to FIG. 1, the display device 100 includes a display panel 110 and a driving circuit 105. The display panel 110 includes a plurality of data lines DL1 to DLm, a plurality of gate lines GL1 to GLn arranged to cross the data lines DL1 to DLm, and a plurality of pixels PX11 to PXnm arranged in areas defined by the data lines DL1 to DLm and the gate lines GL1 to GLn crossing the data lines DL1 to DLm where n and m are natural numbers. The data lines DL1 to DLm are insulated from the gate lines GL1 to GLn.

As shown in FIG. 2, a pixel PXij includes a switching transistor TR and a liquid crystal capacitor Clc where i and j are natural numbers. The switching transistor TR includes a gate electrode connected to an i-th gate line GLi, a first electrode connected to a j-th data line $DL_j$, and a second electrode. The liquid crystal capacitor Clc is connected between the second electrode of the switching transistor TR and a common voltage VCOM. In an exemplary embodiment, the pixels PXij may further include a storage capacitor connected to the liquid crystal capacitor Clc in parallel, for example.

Referring back to FIG. 1, the driving circuit 105 receives image signals RGB, control signals CTRL, and a mode signal FREE_SYNC and controls the display panel 110 to display an image. When the mode signal FREE_SYNC indicates a normal mode, the driving circuit 105 converts the image signals RGB to data voltage signals corresponding to a first gamma curve and applies the data voltage signals to the data lines DL1 to DLm, and when the mode signal FREE_SYNC indicates a frequency variable mode, the driving circuit 105 converts the image signals RGB to data voltage signals corresponding to a second gamma curve different from the first gamma curve and applies the data voltage signals to the data lines DL1 to DLm.

A graphic processor (not shown) connected to the display device 100 applies the mode signal FREE_SYNC indicating whether the display device 100 operates in the normal mode or the frequency variable mode to the driving circuit 105 of the display device 100. In the illustrated exemplary embodiment, the frequency variable mode is an adaptive sync mode in which a frame rate (or frame frequency) is changed at least every frame, and the normal mode is a fixed frequency mode in which the frame rate is constant every frame.

According to another exemplary embodiment, the mode signal FREE_SYNC may be a signal representing the frame rate. In a case where the mode signal FREE_SYNC is the signal representing the frame rate, the driving circuit 105 may determine whether the display device 100 operates in the normal mode or the frequency variable mode depending on the frame rate.

The driving circuit 105 includes a driving controller 120, a voltage generating circuit 130, a gate driver 140, and a data driver 150.

The driving controller 120 receives the image signals RGB, the control signals CTRL, and the mode signal FREE_SYNC. The control signals CTRL may include, for example, a vertical synchronization signal, a horizontal synchronization signal, a main clock signal, and a data enable signal. The driving controller 120 applies image data signals RGB_DATA obtained by processing the image signals RGB appropriate to an operational condition of the display panel 110 based on the control signals CTRL, a first control signal CONT1, and a reference gamma selection signal VSEL to the data driver 150 and applies a second control signal CONT2 to the gate driver 140. The first control signal CONT1 includes a clock signal CLK, a polarity inversion signal POL, and a line latch signal LOAD, and the second control signal CONT2 includes a vertical synchronization start signal. In the illustrated exemplary embodiment, the driving controller 120 outputs the reference gamma selection signal VSEL to the data driver 150 in response to the mode signal FREE_SYNC. The driving controller 120 outputs a voltage control signal CTRLV to the voltage generating circuit 130 in response to the control signals CTRL and the mode signal FREE_SYNC.

The voltage generating circuit 130 generates a plurality of voltages and clock signals desired for the operation of the display panel 110. In the illustrated exemplary embodiment, the voltage generating circuit 130 applies a gate clock signal CKV and a ground voltage VSS to the gate driver 140. In addition, the voltage generating circuit 130 further generates a first driving voltage VGMA_UH, a second driving voltage VGMA_UL, a third driving voltage VGMA_LH, and a fourth driving voltage VGMA_LL, which are desired for the operation of the data driver 150. The voltage generating circuit 130 further generates the common voltage VCOM applied to the display panel 110.

In the illustrated exemplary embodiment, the voltage generating circuit 130 sets a voltage level of each of the first driving voltage VGMA_UH, the second driving voltage VGMA_UL, the third driving voltage VGMA_LH, and the fourth driving voltage VGMA_LL in response to the voltage control signal CTRLV from the driving controller 120.

The gate driver 140 drives the gate lines GL1 to GLn in response to the second control signal CONT2 from the driving controller 120, a gate clock signal CKV from the voltage generating circuit 130, and a ground voltage VS S from the voltage generating circuit 130. The gate driver 140 includes a gate driving integrated circuit ("IC"). The gate driver 140 may be implemented in a circuit with an amorphous silicon gate ("ASG") using an amorphous silicon thin film transistor (a-Si TFT), an oxide semiconductor, a crystalline semiconductor, a polycrystalline semiconductor, or the like in addition to the gate driving IC. The gate driver 140 may be substantially simultaneously formed with the pixels PX11 to PXnm through a thin film process. In this case, the gate driver 140 may be disposed in a predetermined area (e.g., a non-display area) of one side portion of the display panel 110.

Responsive to the image data signals RGB_DATA, the first control signal CONT1, and the reference gamma selection signal VSEL from the driving controller 120, the data driver 150 outputs data voltage signals D1 to Dm using the first driving voltage VGMA_H, the second driving voltage VGMA_L, the third driving voltage VGMA_LH, and the fourth driving voltage VGMA_LL to drive the data lines DL1 to DLm.

While one gate line is driven at a gate-on voltage having a predetermined level by the gate driver 140, the switching transistors of the pixels arranged in one row and connected to the one gate line are turned on. In this case, the data driver 150 applies the data voltage signals D1 to Dm corresponding to the image data signals RGB_DATA to the data lines DL1 to DLm. The data voltage signals D1 to Dm applied to the data lines DL1 to DLm are applied to corresponding liquid crystal capacitors and corresponding storage capacitors through the turned-on switching transistors. Here, the data driver 150 inverts a polarity of each of the data voltage signals D1 to Dm corresponding to the image data signals RGB_DATA to a positive polarity (+) or a negative polarity (−) at every frame to prevent the liquid crystal capacitors from burning and deteriorating. The first driving voltage VGMA_H and the second driving voltage VGMA_UL are used to drive the pixels at the positive polarity, and the third driving voltage VGMA LH and the fourth driving voltage VGMA_LL are used to drive the pixels at the negative polarity.

Figure 3:
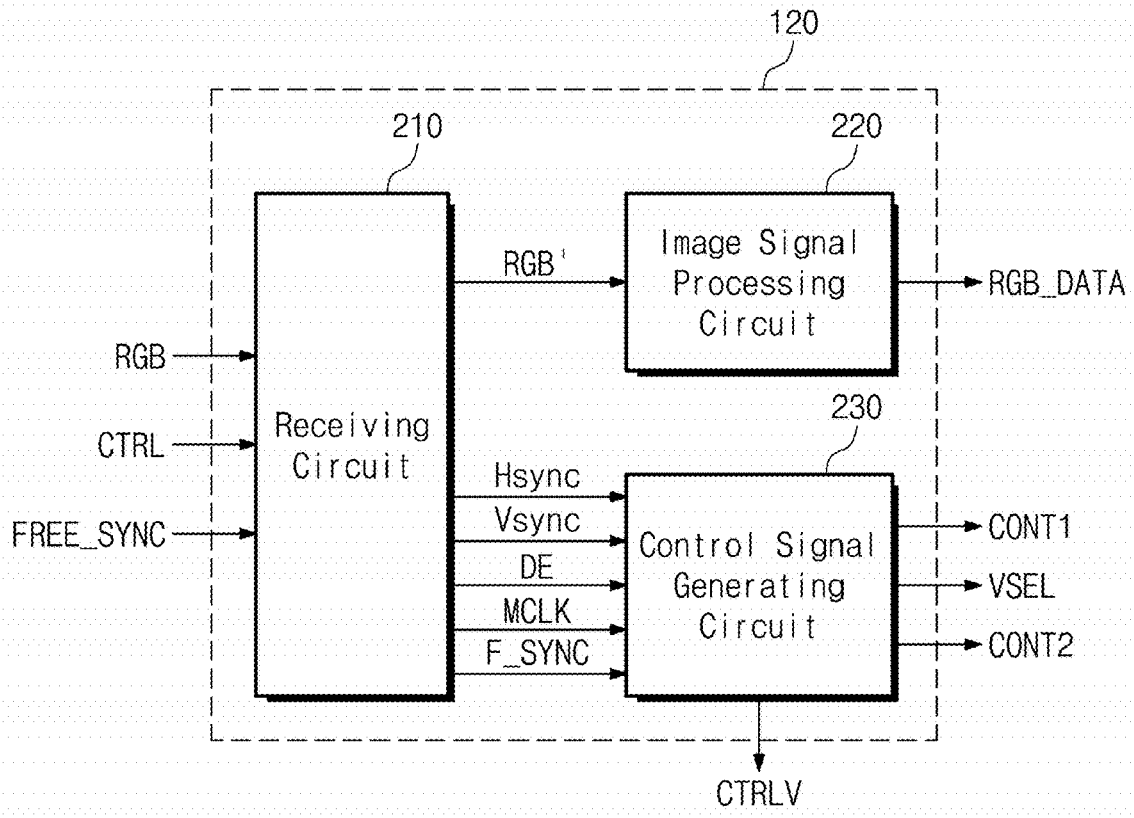
FIG. 3 is a block diagram showing an exemplary embodiment of a configuration of a driving controller according to the invention.

FIG. 3 is a block diagram showing a configuration of the driving controller 120 according to an exemplary embodiment of the invention.

Referring to FIG. 3, the driving controller 120 includes a receiving circuit 210, an image signal processing circuit 220, and a control signal generating circuit 230.

The receiving circuit 210 restores the image signals RGB to image signals RGB'. The receiving circuit 210 restores the horizontal synchronization signal Hsync, the vertical synchronization signal Vsync, the data enable signal DE, and the clock signal MCLK based on the control signals CTRL. As an example, the image signals RGB and the control signals CTRL provided from the outside may be applied to the receiving circuit 210 by a low voltage differential signaling ("LVDS") method. The receiving circuit 210 converts the mode signal FREE_SYNC to a frequency mode signal F_SYNC. In an exemplary embodiment, the mode signal FREE_SYNC may be the signal representing the operational mode (e.g., the normal mode and the frequency variable mode), for example. When the mode signal FREE_SYNC represents the normal mode, the receiving circuit 210 outputs the frequency mode signal F_SYNC at a first level (e.g., a low level), and when the mode signal FREE_SYNC represents the frequency variable mode, the receiving circuit 210 outputs the frequency mode signal F_SYNC at a second level (e.g., a high level). According to another exemplary embodiment, the mode signal FREE_SYNC may be the signal representing the frame rate. When the mode signal FREE_SYNC represents a predetermined frame rate (e.g., about 120 Hertz (Hz)), the receiving circuit 210 outputs the frequency mode signal F_SYNC at the first level (e.g., the low level). When the mode signal FREE_SYNC represents another frame rate other than the predetermined frame rate (e.g., about 120 Hz), the receiving circuit 210 outputs the frequency mode signal F_SYNC at the second level (e.g., the high level). That is, the frequency mode signal F_SYNC may represent one of the normal mode and the frequency variable mode depending on the mode signal FREE_SYNC.

The image signal processing circuit 220 converts the image signals RGB' output from the receiving circuit 210 to the image data signals RGB_DATA and outputs the image data signals RGB_DATA. The image signal processing circuit 220 may output a data signal by linearizing the image signals RGB' such that a gamma characteristic of the image signals RGB' is proportional to a brightness.

The control signal generating circuit 230 receives the horizontal synchronization signal Hsync, the vertical synchronization signal Vsync, the data enable signal DE, the clock signal MCLK, and the frequency mode signal F_SYNC from the receiving circuit 210 and outputs the first control signal CONT1 including the clock signal CLK, the line latch signal LOAD, and the polarity inversion signal POL and the reference gamma selection signal VSEL. In addition, the control signal generating circuit 230 outputs the second control signal CONT2 including the vertical synchronization start signal. The first control signal CONT1 and the reference gamma selection signal VSEL are applied to the data driver 150 shown in FIG. 1, and the second control signal CONT2 is applied to the gate driver 140 shown in FIG. 1. In addition, the control signal generating circuit 230 outputs the voltage control signal CTRLV based on the frequency mode signal F_SYNC. The voltage control signal CTRLV is applied to the voltage generating circuit 130 shown in FIG. 1.

Figure 4:
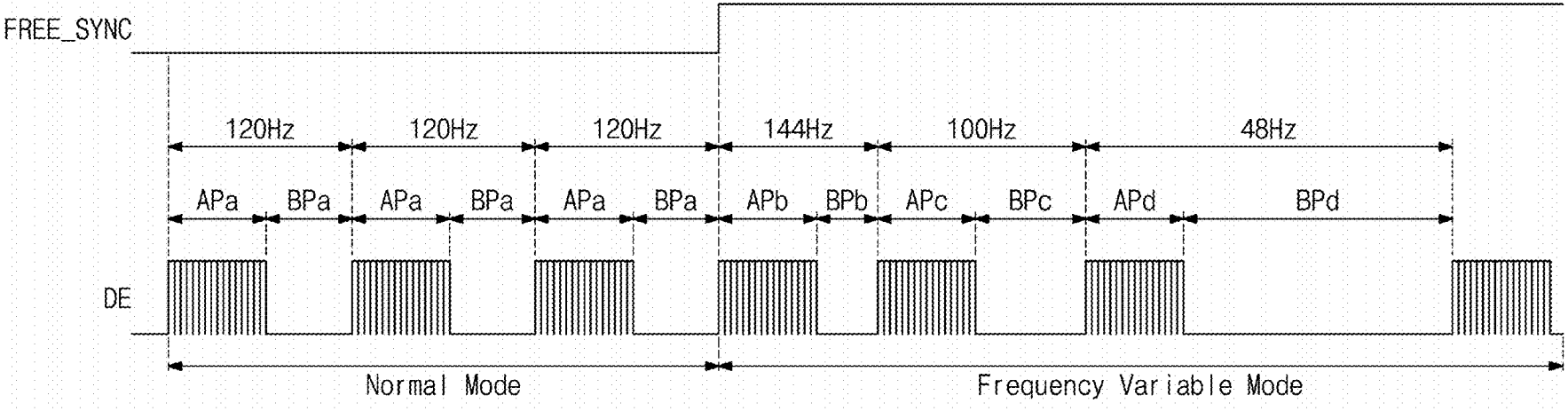
FIG. 4 is a timing diagram showing variations of a mode signal and a data enable signal in a normal mode and a frequency variable mode.

FIG. 4 is a timing diagram showing variations of a mode signal and a data enable signal in a normal mode and a frequency variable mode.

Referring to FIG. 4, the mode signal FREE_SYNC provided from the outside represents the normal mode when being at the low level and represents the frequency variable mode when being at the high level. The frame rate maintains a constant frequency (e.g., about 120 Hz) at every frame during the normal mode in which the mode signal FREE_SYNC has the low level. One frame of the data enable signal DE includes an active period and a blank period. During the normal mode, each of the active period APa and the blank period BPa of the data enable signal DE has the same duration at every frame.

The frame rate may be changed at every frame during the frequency variable mode in which the mode signal FREE_SYNC has the high level. Although the frame rate is changed, the duration of the active period of the data enable signal DE is constant (i.e., APb=APc=APd). However, the duration of the blank period of the data enable signal DE is changed depending on the frame rate. As the frame rate becomes slower during the frequency variable mode, the duration of the blank period of the data enable signal DE becomes longer. In an exemplary embodiment, when the frame rate is about 144 Hz, about 100 Hz, and about 48 Hz, the duration of the blank periods BPb, BPc, and BPd satisfies a relation of BPb<BPc<BPd, for example.

In an exemplary embodiment, when a rendering time of the graphic processor (not shown) increases, the frame rate becomes slower as the increase of the rendering time, and the duration of the blank period of the data enable signal DE becomes longer, for example. When the blank period of the data enable signal DE becomes longer (i.e., the frame rate decreases), electric charges charged in the liquid crystal capacitor Clc of the pixel PXij shown in FIG. 2 decreases by a leakage current. Accordingly, as the blank period becomes longer, the brightness of the image displayed through the display panel 110 decreases. In particular, in a case where the frame rate of consecutive frames is rapidly changed to about 144 Hz, about 48 Hz, about 120 Hz, or about 30 Hz at every frame, a difference in brightness may be perceived by a user.

Figure 5:
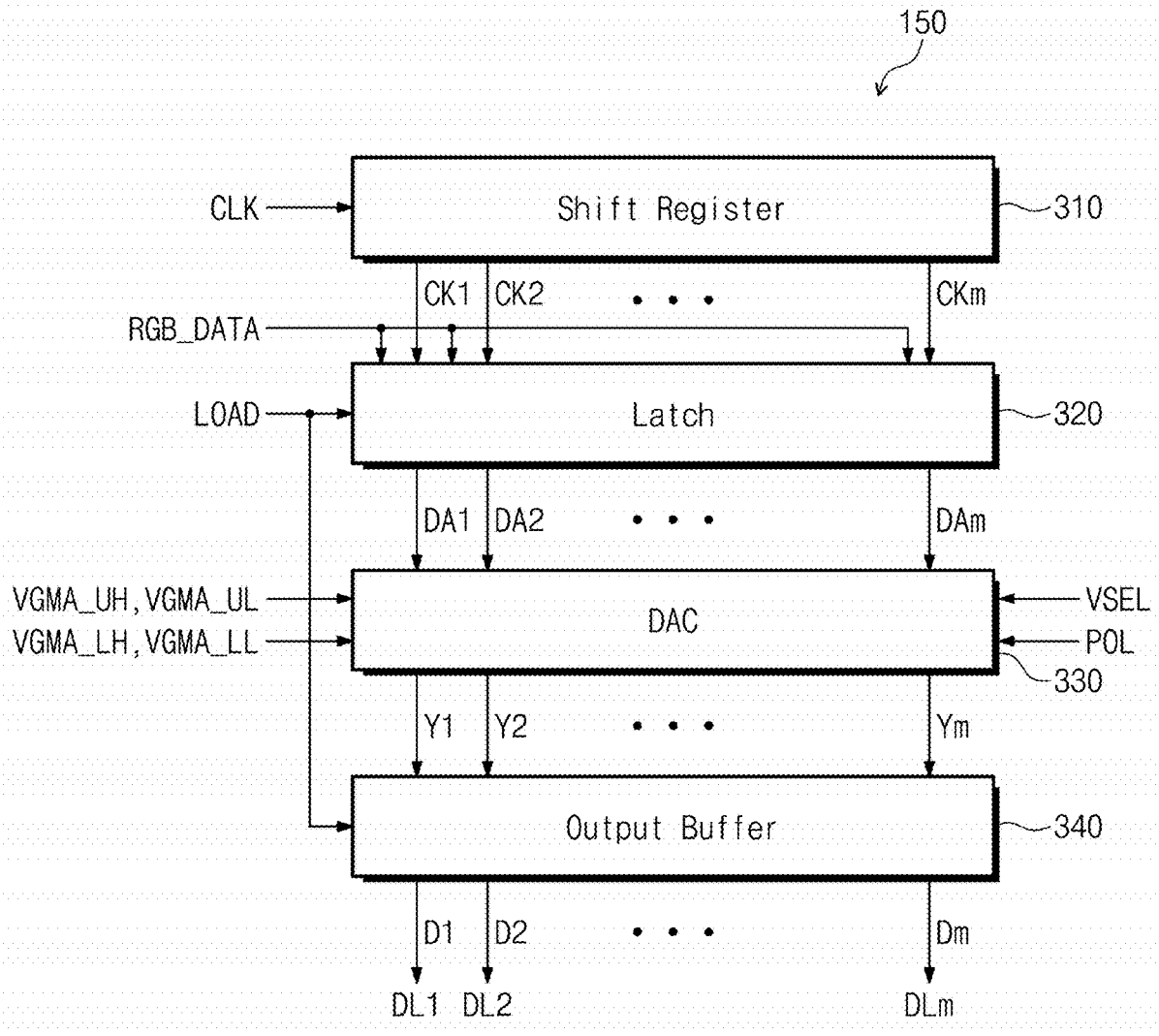
FIG. 5 is a block diagram showing an exemplary embodiment of a configuration of a data driver according to the invention.

FIG. 5 is a block diagram showing a configuration of the data driver 150 according to an exemplary embodiment of the invention.

Referring to FIG. 5, the data driver 150 includes a shift register 310, a latch 320, a digital-to-analog converter ("DAC") 330, and an output buffer 340. In FIG. 5, the clock signal CLK, the line latch signal LOAD, and the polarity inversion signal POL are signals included in the first control signal CONT1 provided from the driving controller 120 shown in FIG. 1.

The shift register 310 sequentially activates latch clock signals CK1 to CKm in synchronization with the clock signal CLK. The latch 320 latches the image data signals RGB_DATA in synchronization with the latch clock signals CK1 to CKm from the shift register 310 and substantially simultaneously applies latch data signals DA1 to DAm to the DAC 330 in response to the line latch signal LOAD.

The DAC 330 receives the polarity inversion signal POL and the reference gamma selection signal VSEL from the driving controller 120 shown in FIG. 1 and the first driving voltage VGMA_UH, the second driving voltage VGMA_UL, the third driving voltage VGMA_LH, and the fourth driving voltage VGMA_LL from the voltage generating circuit 130. The DAC 330 outputs analog voltage signals Y1 to Ym corresponding to the latch data signals DA1 to DAm from the latch 320 to the output buffer 340. The output buffer 340 outputs the analog voltage signals Y1 to Ym from the DAC 330 to the data lines DL1 to DLm as the data voltage signals D1 to Dm.

Figure 6:
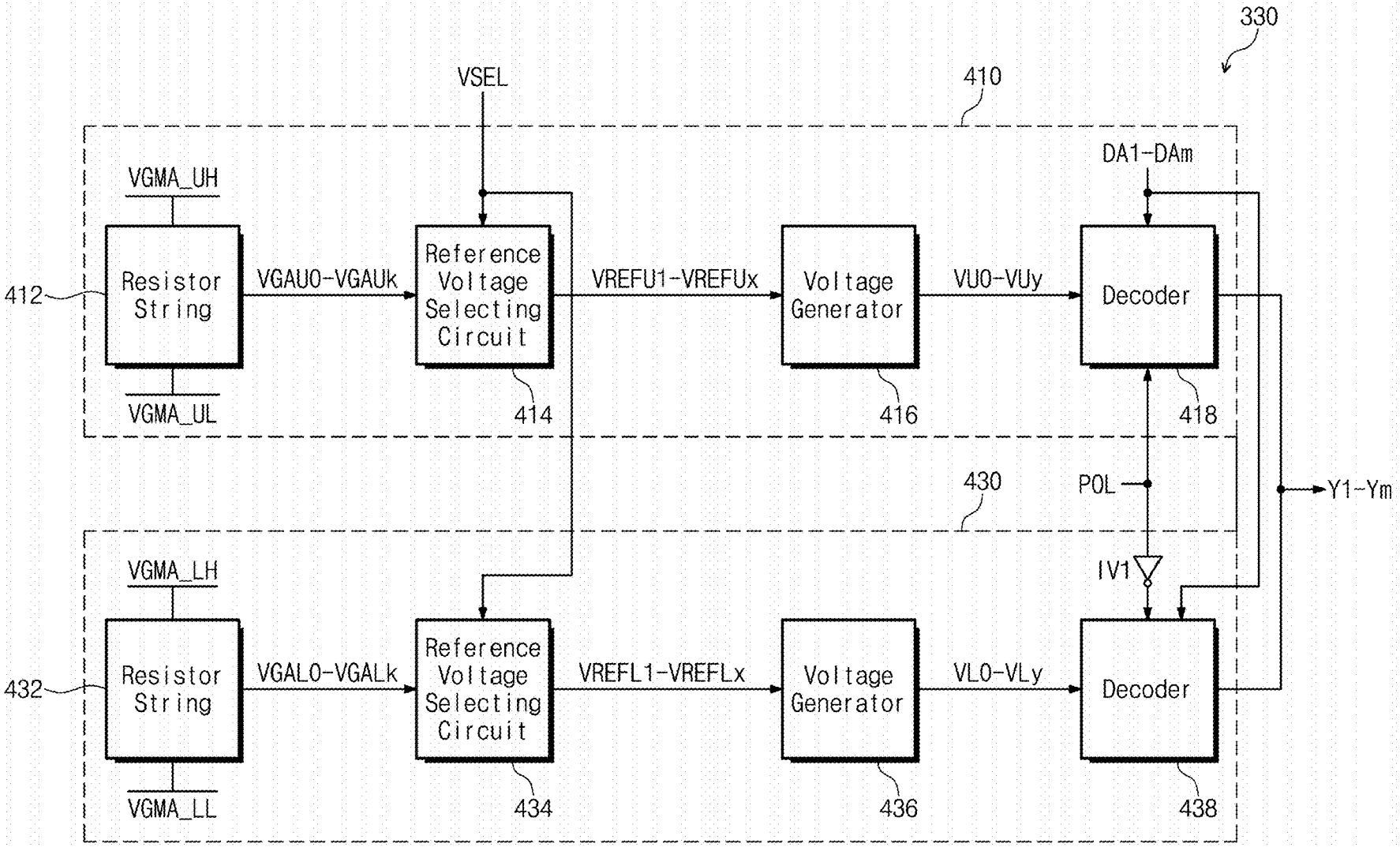
FIG. 6 is a block diagram showing an exemplary embodiment of a configuration of a digital-to-analog converter shown in FIG. 5 according to the invention.

FIG. 6 is a block diagram showing a configuration of the DAC 330 shown in FIG. 5 according to an exemplary embodiment of the invention.

Referring to FIG. 6, the DAC 330 includes a positive polarity converter 410 and a negative polarity converter 430. The positive polarity converter 410 includes a resistor string 412, a reference voltage selecting circuit 414, a voltage generator 416, and a decoder 418.

The resistor string 412 receives the first driving voltage VGMA_UH and the second driving voltage VGMA_UL from the voltage generating circuit 130 shown in FIG. 1 and outputs a plurality of gamma voltages VGAU0 to VGAUk. The resistor string 412 divides the first driving voltage VGMA_UH and the second driving voltage VGMA_UL to output the gamma voltages VGAU0 to VGAUk.

The reference voltage selecting circuit 414 outputs some of the gamma voltages VGAU0 to VGAUk as a plurality of positive polarity reference gamma voltages VREFU1 to VREFUx in response to the reference gamma selection signal VSEL.

The voltage generator 416 generates a plurality of voltages VU0 to VUy based on the positive polarity reference gamma voltages VREFU1 to VREFUx. In this case, each of "k", "x", and "y" is a positive integer number.

The decoder 418 converts the latch data signals DA1 to DAm to the analog voltage signals Y1 to Ym based on the voltages VU0 to VUy during the first level (e.g., the low level) of the polarity inversion signal POL.

The negative polarity converter 430 includes a resistor string 432, a reference voltage selecting circuit 434, a voltage generator 436, and a decoder 438.

The resistor string 432 divides the third driving voltage VGMA_LH and the fourth driving voltage VGMA_LL from the voltage generating circuit 130 shown in FIG. 1 to output a plurality of gamma voltages VGAL0 to VGALk.

The reference voltage selecting circuit 434 outputs some of the gamma voltages VGAL0 to VGALk as a plurality of negative polarity reference gamma voltages VREFL1 to VREFLx in response to the reference gamma selection signal VSEL.

The voltage generator 436 generates a plurality of voltages VL0 to VLy based on the negative polarity reference gamma voltages VREFL1 to VREFLx. In this case, each of "k", "x", and "y" is a positive integer number.

The decoder 438 converts the latch data signals DA1 to DAm to the analog voltage signals Y1 to Ym based on the voltages VL0 to VLy during the second level (e.g., the high level) of the polarity inversion signal POL.

Figure 7:
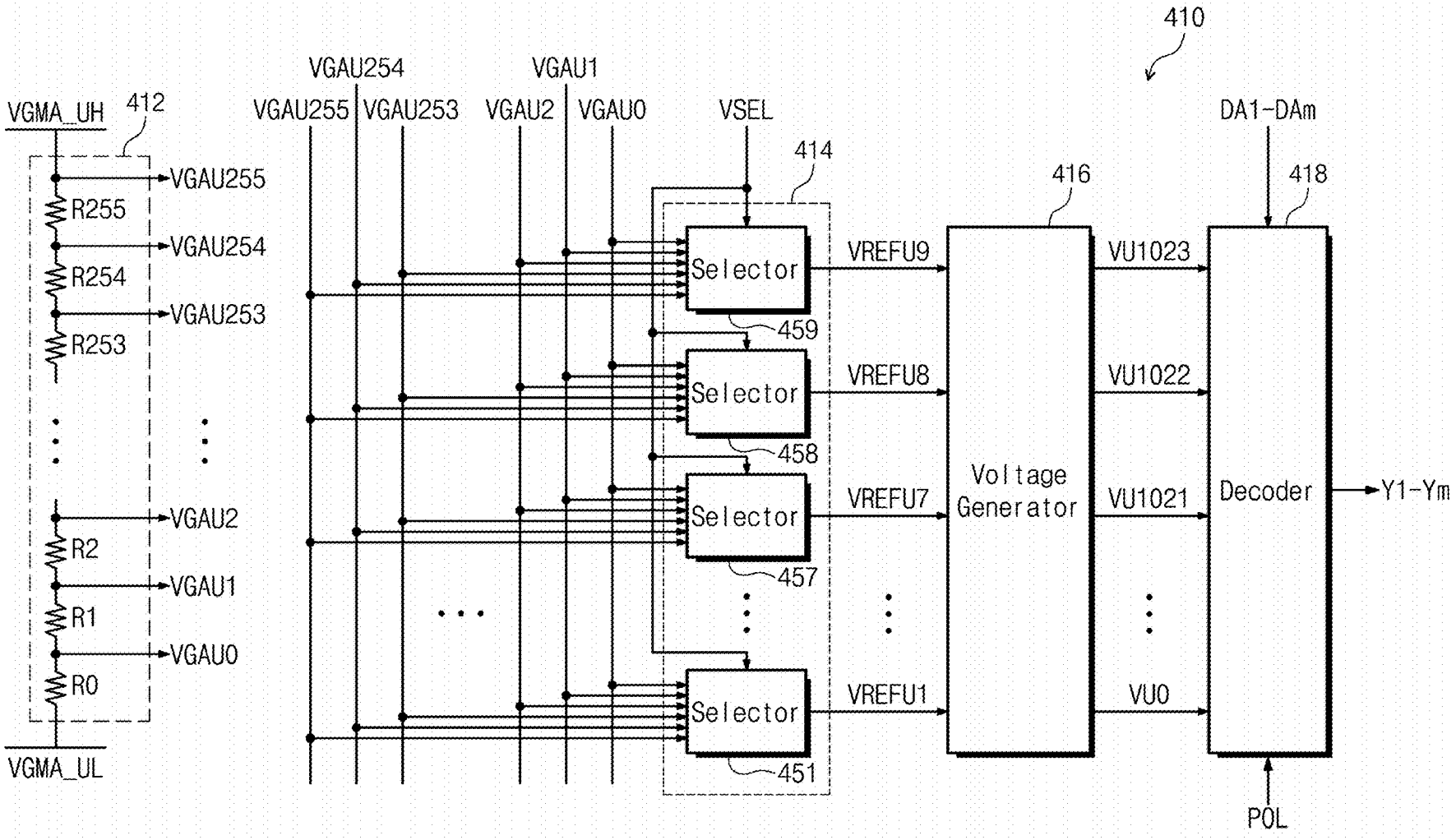
FIG. 7 is a view showing an exemplary embodiment of a configuration of a positive polarity converter shown in FIG. 6 according to the invention.

FIG. 7 is a view showing a configuration of the positive polarity converter 410 shown in FIG. 6 according to an exemplary embodiment of the invention. The "k", "x", and "y" shown in FIG. 6 are 255, 9, and 1023, respectively, in FIG. 7, but they should not be limited thereto or thereby.

Referring to FIG. 7, the resistor string 412 receives the first driving voltage VGMA_UH and the second driving voltage VGMA_UL and outputs the gamma voltages VGAU0 to VGAU255. The resistor string 412 includes resistors R0 to R255 connected to each other in series between the first driving voltage VGMA_UH and the second driving voltage VGMA_UL. Voltages at connection nodes between the resistors R0 to R255 are output as the gamma voltages VGAU0 to VGAU255.

The reference voltage selecting circuit 414 includes selectors 451 to 459. The selectors 451 to 459 output some of the gamma voltages VGAU0 to VGAU255 as the positive polarity reference gamma voltages VREFU1 to VREFU9 in response to the reference gamma selection signal VSEL.

In an exemplary embodiment, the selector 451 outputs the gamma voltage VGAU2 as the positive reference gamma voltage VREFU1, the selector 457 outputs the gamma voltage VGAU120 as the positive reference gamma voltage VREFU7, the selector 458 outputs the gamma voltage VGAU160 as the positive reference gamma voltage VREFU8, and the selector 459 outputs the gamma voltage VGAU253 as the positive reference gamma voltage VREFU9, for example.

The voltage generator 416 receives the positive reference gamma voltages VREFU1 to VREFU9 and generates voltages VU0 to VU1023. The voltage generator 416 may generate a plurality of analog voltage signals due to a voltage division between two adjacent reference voltages. In an exemplary embodiment, the voltage generator 416 may generate the voltage VU0 to VU90 due to a voltage division between the positive polarity reference gamma voltages VREFU1 and VREFU2 and may generate the voltage VU91 to VU120 due to a voltage division between the positive polarity reference gamma voltages VREFU2 and VREFU3, for example. In this way, the voltage generator 416 may generate the voltages VU0 to VU1023 using nine positive polarity reference gamma voltages VREFU1 to VREFU9. The number of the voltages generated by two adjacent reference voltages and a voltage interval between the voltages VU0 to VU1023 based on the positive polarity reference gamma voltages VREFU1 to VREFU9 may be determined according to a method preset in the voltage generator 416.

The decoder 418 converts the latch data signals DA1 to DAm to the analog voltage signals Y1 to Ym based on the voltages VU0 to VU1023 during the second level (e.g., the high level) of the polarity inversion signal POL In the illustrated exemplary embodiment, the resistor string 412 includes 256 resistors to output 256 gamma voltages VGAU0 to VGAU255. However, the number of the resistors and the number of output voltages should not be limited thereto or thereby.

In the illustrated exemplary embodiment, the reference voltage selecting circuit 414 outputs nine voltages of the gamma voltages VGAU0 to VGAU255 as the positive polarity reference gamma voltages VREFU1 to VREFU9. However, the number of the positive polarity reference gamma voltages may be varied in various ways. As the number of the reference voltages increases, a distortion occurring when the received image data signals RGB_DATA are converted to the data voltage signals D1 to Dm may be reduced.

The negative polarity converter 430 shown in FIG. 6 may have the similar configuration as that of the positive polarity converter 410 shown in FIG. 7.

Figure 8:
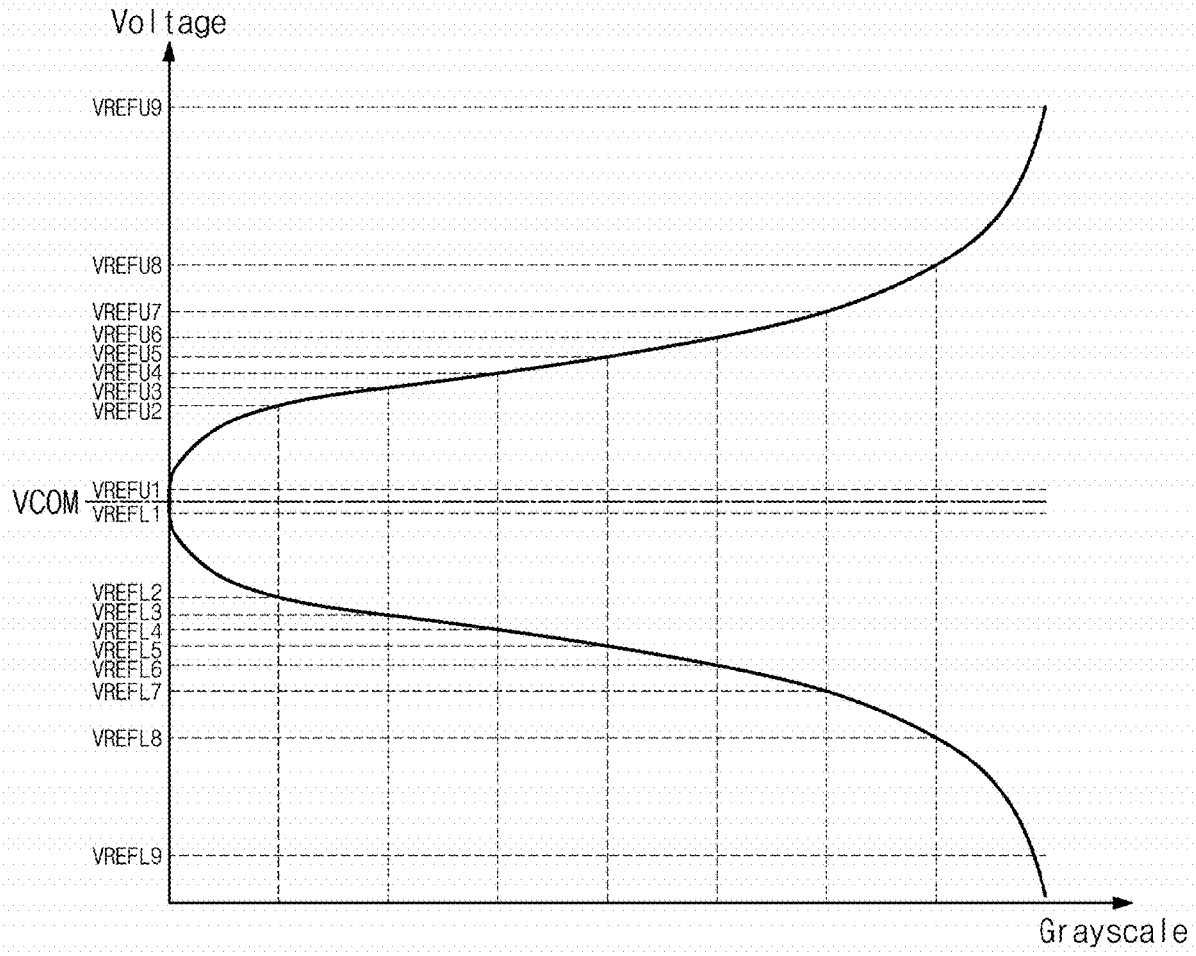
FIG. 8 is a view showing an example of a gamma curve applied to the display device.

FIG. 8 is a view showing an example of a gamma curve applied to the display device.

Referring to FIGS. 7 and 8, the reference voltage selecting circuit 414 outputs some of the gamma voltages VGAU0 to VGAU225 as the positive polarity reference gamma voltages VREFU1 to VREFU9 in response to the reference gamma selection signal VSEL. Similarly, the reference voltage selecting circuit 434 shown in FIG. 6 may output some of the gamma voltages VGAL0 to VGAL225 as the negative polarity reference gamma voltages VREFL1 to VREFL9 in response to the reference gamma selection signal VSEL. Voltage Differences between each of the positive polarity reference gamma voltages VREFU1 to VREFU9 and the common voltage VCOM are equal to voltage differences between each of the negative polarity reference gamma voltages VREFL1 to VREFL9 and the common voltage VCOM.

The positive polarity reference gamma voltage VREFU9 is lower than the first driving voltage VGMA_UH, the positive polarity reference gamma voltage VREFU1 is higher than the second driving voltage VGMA_UL, the negative polarity reference gamma voltage VREFL1 is lower than the third driving voltage VGMA_LH, and the negative polarity reference gamma voltage VREFL9 is higher than the fourth driving voltage VGMA_LL.

The reference gamma selection signal VSEL used to select the positive polarity reference gamma voltages VREFU1 to VREFU9 and the negative polarity reference gamma voltages VREFL1 to VREFL9 in each of the normal mode and the frequency variable mode may be stored in a memory (e.g., a buffer memory or a look-up table) of the driving controller 120 (refer to FIG. 1).

Figure 9:
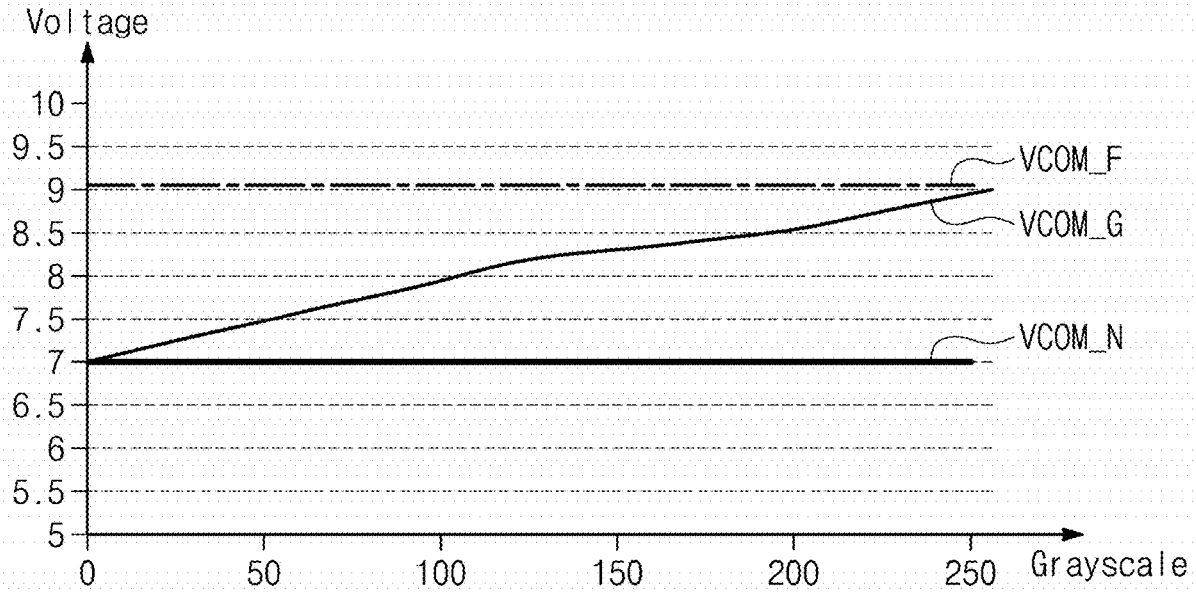
FIG. 9 is a view showing an example of an optimum common voltage according to an operation mode.

FIG. 9 is a view showing an example of an optimum common voltage according to an operation mode.

Referring to FIG. 9, an optimum common voltage VCOM_G to improve the quality of the image displayed through the display panel 110 (refer to FIG. 1) is different for each grayscale level. In the example shown in FIG. 9, the optimum common voltage VCOM_G with respect to the image signals RGB with a black grayscale having the grayscale level of zero (0) is about 7 volts, and the optimum common voltage VCOM_G with respect to the image signals RGB with a white grayscale having the grayscale level of 255 is about 9.1 volts.

In a case where the display panel 110 is operated in a vertical alignment ("VA") mode or a super vertical alignment ("SVA") mode, an afterimage phenomenon in which the image of a previous frame exerts an influence on a current frame may be caused. When the optimum common voltage VCOM_G with respect to the image signals RGB with the black grayscale having the grayscale level of zero (0) is applied to the whole grayscales, the afterimage phenomenon may be improved. Accordingly, a normal mode common voltage VCOM_N that is the optimum common voltage in the normal mode in which the frame rate is not changed is set to as the optimum common voltage of the black grayscale. Therefore, the driving controller 120 shown in FIG. 1 outputs the reference gamma selection signal VSEL and the voltage control signal CTRLV such that the positive polarity reference gamma voltages VREFU1 to VREFU9 and the negative polarity reference gamma voltages VREFL1 to VREFL9 are selected with respect to the normal mode common voltage VCOM_N when the mode signal FREE_SYNC represents the normal mode. The voltage generating circuit 130 (refer to FIG. 1) generates the first driving voltage VGMA_UH, the second driving voltage VGMA_UL, the third driving voltage VGMA_LH, and the fourth driving voltage VGMA_LL corresponding to the normal mode common voltage VCOM_N in response to the voltage control signal CTRLV.

However, in a case where the positive polarity reference gamma voltages VREFU1 to VREFU9 and the negative polarity reference gamma voltages VREFL1 to VREFL9 are selected with respect to the optimum common voltage of the black grayscale during the frequency variable mode, the brightness difference may be perceived better when the frame rate is changed. Although the optimum common voltage of the white grayscale is higher than the optimum common voltage of the black grayscale, an imbalance occurs between the voltage difference between the common voltage VCOM and the positive polarity reference gamma voltages VREFU1 to VREFU9 and the voltage difference between the common voltage VCOM and the negative polarity reference gamma voltages VREFL1 to VREFL9 since the image signals RGB of the white grayscale are converted to the data voltage signals D1 to Dm with respect to the optimum common voltage of the black grayscale. In particular, when the frame rate is changed every frame, the brightness difference may be perceived better due to the imbalance between the voltage differences.

Accordingly, in the illustrated exemplary embodiment of the invention, a frequency variable mode common voltage VCOM_F that is the optimum common voltage during the frequency variable mode is set as the optimum common voltage with respect to the image signals RGB with the white grayscale. The driving controller 120 outputs the reference gamma selection signal VSEL and the voltage control signal CTRLV such that the positive polarity reference gamma voltages VREFU1 to VREFU9 and the negative polarity reference gamma voltages VREFL1 to VREFL9 are selected with respect to the frequency variable mode common voltage VCOM_F when the mode signal FREE_SYNC represents the frequency variable mode.

Figure 10:
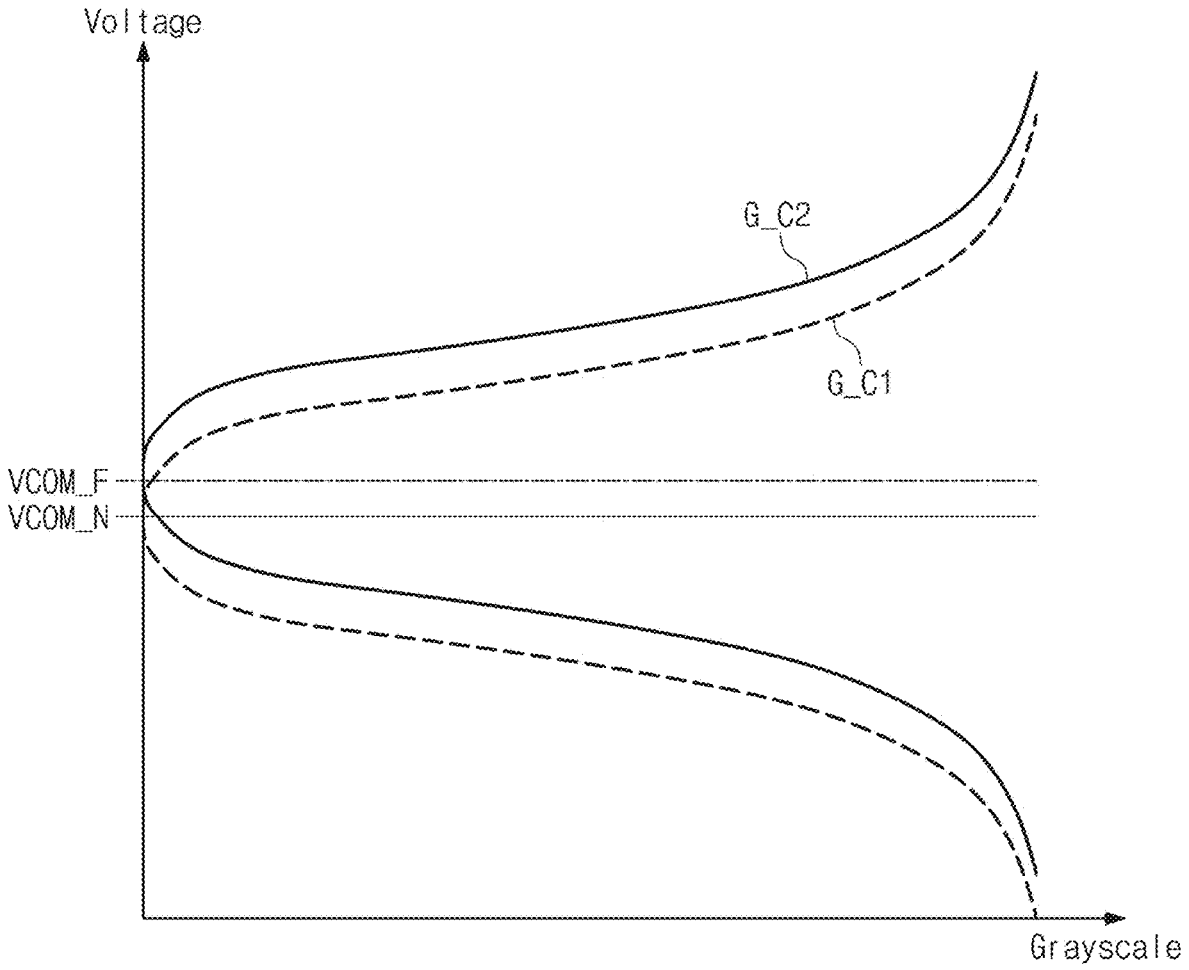
FIG. 10 is a view showing an example of a first gamma curve and a second gamma curve according to the operation mode.

FIG. 10 is a view showing an example of a first gamma curve G_C1 and a second gamma curve G_C2 according to the operation mode.

Referring to FIG. 10, the first gamma curve G_C1 is formed by the positive polarity reference gamma voltages VREFU1 to VREFU9 and the negative polarity reference gamma voltages VREFL1 to VREFL9 selected with respect to the normal mode common voltage VCOM_N. The second gamma curve G_C2 is formed by the positive polarity reference gamma voltages VREFU1 to VREFU9 and the negative polarity reference gamma voltages VREFL1 to VREFL9 selected with respect to the frequency variable mode common voltage VCOM_F.

In the illustrated exemplary embodiment, the voltage level of the frequency variable mode common voltage VCOM_F is higher than the voltage level of the normal mode common voltage VCOM_N. However, according to another exemplary embodiment, the voltage level of the normal mode common voltage VCOM_N may be higher than the voltage level of the frequency variable mode common voltage VCOM_F.

Figure 11:
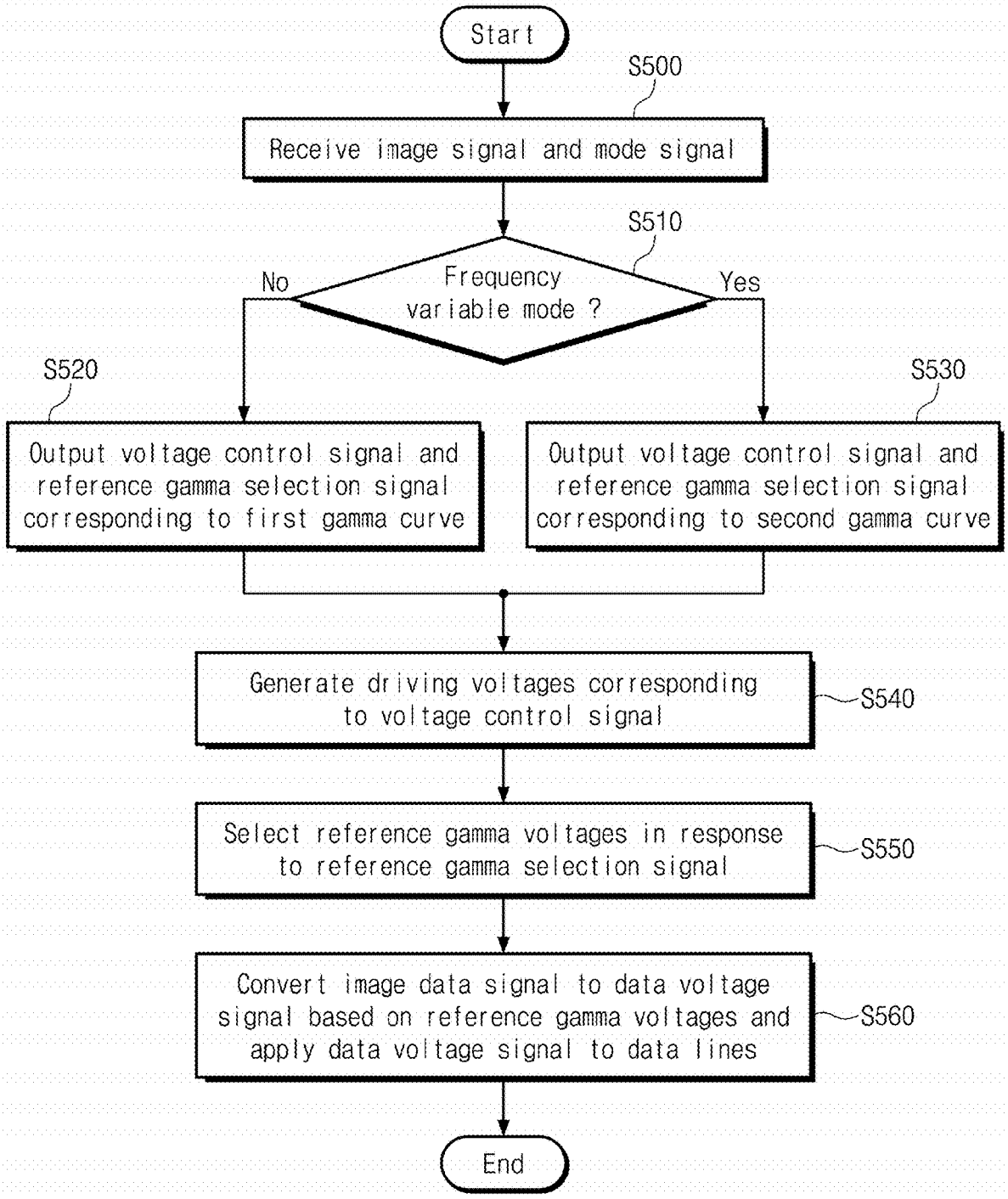
FIG. 11 is a flowchart showing an exemplary embodiment of a method of driving the display device according to the invention.

FIG. 11 is a flowchart showing a method of driving the display device according to an exemplary embodiment of the invention.

Referring to FIGS. 1 and 11, the driving controller 120 receives the image signals RGB and the mode signal FREE_SYNC (S500). The driving controller 120 converts the image signals RGB to the image data signals RGB_DATA and applies the image data signals RGB_DATA to the data driver 150.

The driving controller 120 determines whether the mode signal FREE_SYNC represents the normal mode or the frequency variable mode (S510). When the mode signal FREE_SYNC represents the normal mode, the driving controller 120 outputs the voltage control signal CTRLV and the reference gamma selection signal VSEL corresponding to the first gamma curve G_C1 (refer to FIG. 10) (S520). When the mode signal FREE SYNC represents the frequency variable mode, the driving controller 120 outputs the voltage control signal CTRLV and the reference gamma selection signal VSEL corresponding to the second gamma curve G_C2 (refer to FIG. 10) (S530).

The voltage generating circuit 130 generates the first driving voltage VGMA UH, the second driving voltage VGMA_UL, the third driving voltage VGMA_LH, and the fourth driving voltage VGMA_LL in response to the voltage control signal CTRLV (S540).

The data driver 150 selects the positive polarity reference gamma voltages VREFU1 to VREFU9 and the negative polarity reference gamma voltages VREFL1 to VREFL9 in response to the reference gamma selection signal VSEL (S550).

The data driver 150 converts the image data signals RGB_DATA to the data voltage signals D1 to Dm based on the positive polarity reference gamma voltages VREFU1 to VREFU9 and the negative polarity reference gamma voltages VREFL1 to VREFL9 and applies the data voltage signals D1 to Dm to the data lines DL1 to DLm (S560).

Although the exemplary embodiments of the invention have been described, it is understood that the invention should not be limited to these exemplary embodiments but various changes and modifications may be made by one ordinary skilled in the art within the spirit and scope of the invention as hereinafter claimed.

What is claimed is:

1. A display device comprising:

a display panel comprising a plurality of gate lines, a plurality of data lines, and a plurality of pixels each being connected to a corresponding gate line of the plurality of gate lines and a corresponding data line of the plurality of data lines; and a driving circuit which controls the display panel in response to an image signal, a control signal, and a mode signal from an outside to display an image through the display panel, wherein the driving circuit converts the image signal to data voltage signals corresponding to a first gamma curve to apply the data voltage signals to the plurality of data lines when the mode signal represents a normal mode and converts the image signal to data voltage signals corresponding to a second gamma curve different from the first gamma curve to apply the data voltage signals to the plurality of data lines when the mode signal represents a frequency variable mode, wherein the driving circuit restores a data enable signal based on the control signal, wherein a duration of an active period of the data enable signal is constant in the frequency variable mode independent of a frame rate for each frame, and wherein the data enable signal comprises a display period and a blank period in one frame, and a duration of the blank period of the data enable signal becomes different at least every one frame in the frequency variable mode, the duration of the blank period of the data enable signal in the frequency variable mode is shorter than the duration of the blank period of the data enable signal in the normal mode when the frame rate in the frequency variable mode is greater than the frame rate in the normal mode, and the duration of the blank period of the data enable signal in the frequency variable mode is longer than the duration of the blank period of the data enable signal in the normal mode when the frame rate in the frequency variable mode is less than the frame rate in the normal mode.

2. The display device of claim 1, wherein a voltage level of the data voltage signals converted in the frequency variable mode is higher than a voltage level of the data voltage signals converted in the normal mode when the image signal has a predetermined grayscale level.

3. The display device of claim 1, wherein the first gamma curve is formed with respect to a first common voltage level optimized when the image signal has a black image pattern, and the second gamma curve is formed with respect to a second common voltage level optimized when the image signal has a white image pattern.

4. The display device of claim 1, wherein the frequency variable mode is an adaptive sync mode in which a frame rate is changed at least every frame, and the normal mode is a fixed frequency mode in which the frame rate is constant every frame.

5. The display device of claim 1, wherein the driving circuit comprises:

a gate driver which drives the plurality of gate lines;

a data driver which applies the data voltage signals to the plurality of data lines based on an image data signal, a reference gamma selection signal, and at least one driving voltage;

a voltage generating circuit which generates the at least one driving voltage in response to a voltage control signal; and a driving controller which controls the gate driver in response to the image signal, the control signal, and the mode signal and applies the image data signal and the reference gamma selection signal to the data driver, and wherein the driving controller outputs the voltage control signal and the reference gamma selection signal corresponding to the first gamma curve when the mode signal represents the normal mode and outputs the voltage control signal and the reference gamma selection signal corresponding to the second gamma curve when the mode signal represents the frequency variable mode.

6. The display device of claim 5, wherein the driving controller comprises:

a receiving circuit which restores the data enable signal and a clock signal based on the control signal and converts the mode signal to a frequency mode signal; and a control signal generating circuit which applies a first control signal and a second control signal to the data driver and the gate driver, respectively, in response to the data enable signal and the clock signal, outputs the voltage control signal and the reference gamma selection signal corresponding to the first gamma curve when the frequency mode signal has a first level, and outputs the voltage control signal and the reference gamma selection signal corresponding to the second gamma curve when the frequency mode signal has a second level.

7. The display device of claim 6, wherein the data driver comprises:

a shift register which outputs latch clock signals in synchronization with the clock signal;

a latch circuit which receives the image data signal and outputs a data signal in synchronization with the latch clock signals;

a digital-to-analog converter which receives the reference gamma selection signal and the at least one driving voltage and converts the data signal output from the latch circuit to an analog voltage signal; and an output buffer which outputs the analog voltage signal to the plurality of data lines as the data voltage signals.

8. The display device of claim 7, wherein the voltage generating circuit generates a first driving voltage and a second driving voltage in response to the voltage control signal.

9. The display device of claim 8, wherein the digital-to-analog converter comprises:

a resistor string which generates a plurality of gamma voltages between the first driving voltage and the second driving voltage;

a reference voltage selecting circuit which selects gamma voltages among the plurality of gamma voltages in response to the reference gamma selection signal and outputs the selected gamma voltages as a plurality of reference gamma voltages;

a voltage generator which generates a plurality of voltages based on the plurality of reference gamma voltages; and a decoder which outputs a voltage corresponding to the data signal among the plurality of voltages as the analog voltage signal.

10. The display device of claim 9, wherein the reference voltage selecting circuit comprises a plurality of selectors each of which receives the plurality of gamma voltages and outputs one of the plurality of gamma voltages as a reference gamma voltage of the plurality of reference gamma voltages in response to the reference gamma selection signal.

11. The display device of claim 9, wherein the resistor string comprises a plurality of resistors connected to each other in series between the first driving voltage and the second driving voltage and outputs voltages of connection nodes between the resistors as the plurality of gamma voltages.

12. A display device comprising:

a display panel comprising a plurality of gate lines, a plurality of data lines, and a plurality of pixels each being connected to a corresponding gate line of the plurality of gate lines and a corresponding data line of the plurality of data lines;

a gate driver which drives the plurality of gate lines;

a data driver which applies data voltage signals to the plurality of data lines based on an image data signal, a reference gamma selection signal, and at least one driving voltage;

a voltage generating circuit which generates the at least one driving voltage in response to a voltage control signal; and a driving controller which controls the gate driver in response to an image signal, a control signal, and a mode signal from an outside and applies the image data signal and the reference gamma selection signal to the data driver, wherein the driving controller outputs the voltage control signal and the reference gamma selection signal corresponding to a first common voltage level when the mode signal represents a normal mode and outputs the voltage control signal and the reference gamma selection signal corresponding to a second common voltage level different from the first common voltage level when the mode signal represents a frequency variable mode, wherein the driving controller restores a data enable signal based on the control signal, wherein a duration of an active period of the data enable signal is constant in the frequency variable mode independent of a frame rate for each frame, and wherein the data enable signal comprises a display period and a blank period in one frame, and a duration of the blank period of the data enable signal becomes different at least every one frame in the frequency variable mode, the duration of the blank period of the data enable signal in the frequency variable mode is shorter than the duration of the blank period of the data enable signal when in the normal mode the frame rate in the frequency variable mode is greater than the frame rate in the normal mode, and the duration of the blank period of the data enable signal in the frequency variable mode is longer than the duration of the blank period of the data enable signal in the normal mode when the frame rate in the frequency variable mode is less than the frame rate in the normal mode.

13. The display device of claim 12, wherein the second common voltage level has a voltage level higher than a voltage level of the first common voltage level.

14. The display device of claim 12, wherein the first common voltage level is a common voltage level optimized when the image signal has a black image pattern, and the second common voltage level is a common voltage level optimized when the image signal has a white image pattern.

15. The display device of claim 12, wherein the voltage generating circuit generates a first driving voltage and a second driving voltage in response to the voltage control signal, and the data driver comprises:

a resistor string which generates a plurality of gamma voltages between the first driving voltage and the second driving voltage;

a reference voltage selecting circuit which selects gamma voltages among the plurality of gamma voltages in response to the reference gamma selection signal and outputs the selected gamma voltages as a plurality of reference gamma voltages;

a voltage generator which generates a plurality of voltages based on the reference gamma voltages; and a decoder which outputs a voltage corresponding to a data signal among the voltages as an analog voltage signal.

16. The display device of claim 12, wherein the frequency variable mode is an adaptive sync mode in which a frame rate is changed at least every frame, and the normal mode is a fixed frequency mode in which the frame rate is constant every frame.

17. A method of driving a display device, the method comprising:

receiving a control signal an image signal and a mode signal;

restoring a data enable signal based on the control signal;

converting the image signal to a data voltage signal corresponding to a first gamma curve when the mode signal represents a normal mode;

converting the image signal to a data voltage signal corresponding to a second gamma curve different from the first gamma curve when the mode signal represents a frequency variable mode; and applying the data voltage signal to a plurality of data lines, wherein a duration of an active period of the data enable signal is constant in the frequency variable mode independent of a frame rate for each frame, and wherein the data enable signal comprises a display period and a blank period in one frame, and a duration of the blank period of the data enable signal becomes different at least every one frame in the frequency variable mode, the duration of the blank period of the data enable signal in the frequency variable mode is shorter than the duration of the blank period of the data enable signal in the normal mode when the frame rate in the frequency variable mode is greater than the frame rate in the normal mode, and the duration of the blank period of the data enable signal in the frequency variable mode is longer than the duration of the blank period of the data enable signal in the normal mode when the frame rate in the frequency variable mode is less than the frame rate in the normal mode.

18. The method of claim 17, wherein the converting the image signal to the data voltage signal corresponding to the first gamma curve comprises:

outputting a voltage control signal and a reference gamma selection signal corresponding to the first gamma curve;

generating at least one driving voltage corresponding to the voltage control signal;

selecting gamma voltages among a plurality of gamma voltages as reference gamma voltages in response to the reference gamma selection signal; and converting the image signal to the data voltage signal in response to the at least one driving voltage and the reference gamma voltages.

19. The method of claim 18, wherein the converting the image signal to the data voltage signal corresponding to the second gamma curve comprises:

outputting a voltage control signal and a reference gamma selection signal corresponding to the second gamma curve;

selecting gamma voltages among the plurality of gamma voltages as reference gamma voltages in response to the reference gamma selection signal; and converting the image signal to the data voltage signal in response to the at least one driving voltage and the reference gamma voltages.

* * * * *